US007059603B1

(12) United States Patent
D'Avanzo

(10) Patent No.: US 7,059,603 B1
(45) Date of Patent: Jun. 13, 2006

(54) WAGERING GAME

(75) Inventor: Scott D'Avanzo, Laguna Hills, CA (US)

(73) Assignee: Adrenalin Gaming LLC, Ladera Ranch, CA (US)

( * ) Notice: Subject to any disclaimer, the term of this patent is extended or adjusted under 35 U.S.C. 154(b) by 92 days.

(21) Appl. No.: 10/625,815

(22) Filed: Jul. 22, 2003

Related U.S. Application Data

(63) Continuation-in-part of application No. 10/141,907, filed on May 8, 2002, now abandoned.

(51) Int. Cl.
*A63F 1/00* (2006.01)

(52) U.S. Cl. ..... 273/292; 273/274; 463/13

(58) Field of Classification Search ..... 273/292, 273/138.1; 463/16–20
See application file for complete search history.

(56) References Cited

U.S. PATENT DOCUMENTS 4,364,567 A * 12/1982 Goott ..... 273/237
4,861,041 A * 8/1989 Jones et al. ..... 273/292
5,118,114 A * 6/1992 Tucci ..... 273/274
5,121,920 A * 6/1992 Laezzo et al. ..... 273/144 B
5,288,077 A * 2/1994 Jones ..... 273/292
5,364,105 A * 11/1994 Jones ..... 273/292
5,377,973 A * 1/1995 Jones et al. ..... 463/12
5,452,900 A * 9/1995 Skratulia et al. ..... 273/292
5,544,892 A * 8/1996 Breeding ..... 273/292
5,549,300 A * 8/1996 Sardarian ..... 273/292
5,639,089 A * 6/1997 Matsumoto et al. .... 273/142 E
5,660,393 A * 8/1997 Dreger ..... 273/292
5,690,337 A * 11/1997 Somma et al. ..... 273/309
5,791,989 A * 8/1998 Slinkman ..... 463/12
5,823,534 A * 10/1998 Banyai ..... 273/269
5,845,903 A * 12/1998 Sloan ..... 273/144 R
5,364,105 A * 5/1999 Jones ..... 273/292
5,954,335 A * 9/1999 Moody ..... 273/292
6,019,374 A * 2/2000 Breeding ..... 273/292
6,158,741 A * 12/2000 Koelling ..... 273/292
6,270,407 B1 * 8/2001 Dodge ..... 463/18
6,273,424 B1 * 8/2001 Breeding ..... 273/292
6,276,689 B1 * 8/2001 Brown ..... 273/292
6,315,290 B1 * 11/2001 Roethel et al. ..... 273/138.1
6,334,614 B1 * 1/2002 Breeding ..... 273/292
6,368,212 B1 * 4/2002 Moody ..... 463/13
6,416,406 B1 * 7/2002 Duhamel ..... 463/12
6,471,208 B1 * 10/2002 Yoseloff et al. ..... 273/143 R
6,527,270 B1 * 3/2003 Maksymec et al. ..... 273/138.1
6,568,677 B1 * 5/2003 Brenner ..... 273/144 B
6,582,307 B1 * 6/2003 Webb ..... 463/22
6,659,461 B1 * 12/2003 Yoseloff et al. ..... 273/274

(Continued)

*Primary Examiner*—Eugene Kim
*Assistant Examiner*—Dolores Collins
(74) *Attorney, Agent, or Firm*—Rob L. Phillips; Greenberg Traurig

(57) ABSTRACT

In a table game, ideally a game of blackjack, a player has an option of making 2nd chance wagers prior to any cards being dealt. A first type of 2nd chance wager is that the player's first two dealt cards have a total point value of "21." A second type of 2nd chance wager is that a dealer's first two dealt cards have a total point value of "21." When the player wins a 2nd chance wager, the dealer causes a numbered ball to be captured from a ball dispenser. The amount of the 2nd chance wager is multiplied by the number on the captured ball to determine the payout associated with the 2nd chance wager. Alternatively, the ball number or a summation of ball numbers may be used to calculate a cash value of the payout.

11 Claims, 2 Drawing Sheets

U.S. PATENT DOCUMENTS 6,676,128 B1 * 1/2004 Wolf ..... 273/292
6,743,094 B1 * 6/2004 Johnson ..... 463/17
2001/0000933 A1 * 5/2001 Koelling ..... 273/292
2002/0039923 A1 * 4/2002 Cannon et al. ..... 463/42
2002/0101035 A1 * 8/2002 Wolf ..... 273/292
2002/0153656 A1 * 10/2002 Maksymec et al. ..... 273/138.1
2002/0195773 A1 * 12/2002 Dunn ..... 273/274
2003/0073476 A1 * 4/2003 Friedman ..... 463/13
2003/0073485 A1 * 4/2003 Friedman ..... 463/22
2003/0075863 A1 * 4/2003 Friedman ..... 273/146
2003/0114219 A1 * 6/2003 McClintic ..... 463/25
2003/0127793 A1 * 7/2003 Adams ..... 273/138.2
2003/0189291 A1 * 10/2003 Zimmer et al. ..... 273/303
2003/0216170 A1 * 11/2003 Walker et al. ..... 463/25
2004/0053673 A1 * 3/2004 Mishra ..... 463/20
2004/0053683 A1 * 3/2004 Hartl et al. ..... 463/25

* cited by examiner

WAGERING GAME

CROSS REFERENCE TO RELATED APPLICATIONS

This application is a continuation-in-part of application Ser. No. 10/141,907 filed May 8, 2002, now abandoned entitled "2$^{ND}$ CHANCE TWENTY ONE."

FIELD OF INVENTION

The embodiments of the present invention relate to casino wagering games.

BACKGROUND

This invention is in the general field of casino gaming and, more particularly, is an adjunct to the game of twenty one.

Twenty one, also known as blackjack, is a game played at a semicircular table with seven player stations equally spaced on the table's top near an arcuate edge thereof. A player station has an imprint of a circle. A player at the station places cheques, chips, tokens or cash representative of a wager within the circle. A dealer is positioned near a straight edge of the table. The dealer faces the player.

Twenty one is played with one or more standard decks of cards. An ace dealt to a player has a point value of either "1" or "11" at the election of the player; a face card (jack, queen or king) has a point value of "10" and each of the remaining cards ("2" through "10") have a point value equal to what is alternatively referred to as a "pip" value or a number value. Point values of cards held by the player are added together to obtain a total point value. A total point value of cards held by the dealer is obtained in a similar manner.

After the cheques are placed within the circle, the cards are shuffled and the player and the dealer are each dealt a hand comprised of two cards. The two cards of the player's hand are dealt face-up. A first card of the dealer's hand is dealt face-down. A second card of the dealer's hand is dealt face-up. The players and dealer are dealt cards, one at a time, in a clockwise fashion beginning with a player to the dealer's most left position.

Whenever the dealer's face-up card is either an ace or has a point value of "10", the dealer ascertains the point value of the face-down card without revealing it to the player. When the dealer's two dealt cards have a total point value of "21," the dealer is said to have blackjack whereupon the dealer turns the face-down card face up. Similarly, when a player's two dealt cards have the total point value of "21," the player is said to have blackjack.

When the dealer has blackjack, the dealer wins the wager with two exceptions. A first exception occurs when the dealer's face up card is an ace and the player makes what is known as an insurance bet which is typically equal to one half, or less, of the wager. When the dealer does not have blackjack, the player loses the insurance bet. Conversely, when the dealer has blackjack, the player wins the insurance bet. When the player wins, cheques representative of the wager and two and one half times the insurance bet are returned to the player.

The second exception occurs when the player has blackjack whereupon the cheques representative of the wager are returned to the player. The second exception is an example of when the player's hand and the dealer's hand have the same total point value and is referred to as a push.

When the player has blackjack and the dealer does not, the player wins the wager and is typically paid 3 to 2 on his or her wager. When neither the dealer nor the player have blackjack, the player has four options.

A first option is to have the player's hand augmented by what is called a draw card (referred to as a "hit"). The player may have successive hits until the player total point value exceeds "21." When the total point value of a hand exceeds "21" it is said to bust. The player loses the wager when the player's hand busts. Therefore, busting is a sudden, catastrophic termination of play for the player.

A second option is not to have the player's hand augmented by the draw card (referred to as a "stand"). The player may stand at any time that the player's hand has not busted.

A third option, referred to as doubling down, permits the player to double the wager and receive one additional card.

A fourth option is available when the player's hand is comprised of two cards that are a pair, such as a pair of queens, for example. The player may split the pair into first and second hands. An additional card is dealt to the player's first hand and to the player's second hand. The player's first and second hands are then each played as described hereinbefore.

The decision to hit or stand is made with an objective of causing the total point value of the payer's hand to be closer to "21" than the total point value of the dealer's hand. It should be understood that central factors in making the decision are the dealer's face-up card and the total point value of the player's hand.

After the player stands, the dealer's face-down card is turned face-up, whereby both cards of the dealer's hand are face-up. When the total point value of the dealer's hand is less than "17," the dealer must hit until the total point value of the dealer's hand is at least "17." When a hit causes the dealer's hand to bust and the player's hand has not busted, the player wins the wager.

It should be understood that when an exemplary hand includes an ace and a six, for example, it is referred to as a soft "17" because the ace causes the exemplary hand to have alternative point values of "7" and "17." Usually, the dealer's hand cannot be hit when it is the soft "17."

When neither the player's hand nor the dealer's hand busts and the total point value of the dealer's hand exceeds the total point value of the player's hand, the dealer wins and vice versa. When there is a push, there is no winner; the cheques representative of the wager are returned to the player.

SUMMARY OF THE INVENTION

According to the present invention, in a game of twenty one, a player has an option of making 2nd chance wagers before cards are dealt. The 2nd chance wagers can take various forms, but ideally they are based on the dealer's cards or the player's cards. In one embodiment, the player wins a 2nd chance wager when a first two cards dealt to the player have a total point value of "21." Similarly, the player may place a 2nd chance wager based on a first two cards dealt to a dealer having a total point value of "21." In response to winning a 2nd chance wager, a number is randomly selected from a number pool. In one embodiment, the player receives a payout equal to an amount of the winning 2nd chance wager multiplied by the selected number. Alternatively, the numbers may correspond to cash amounts.

The random selection of the numbers from a numbers pool is facilitated by an apparatus including a ball container, ball agitator and means for isolating one or more of the balls. The apparatus can be attached to a gaming table or adjacent thereto.

DESCRIPTION

While any casino table game may benefit from the embodiments of the present invention, blackjack is used to describe the embodiments in detail.

Figure 1:
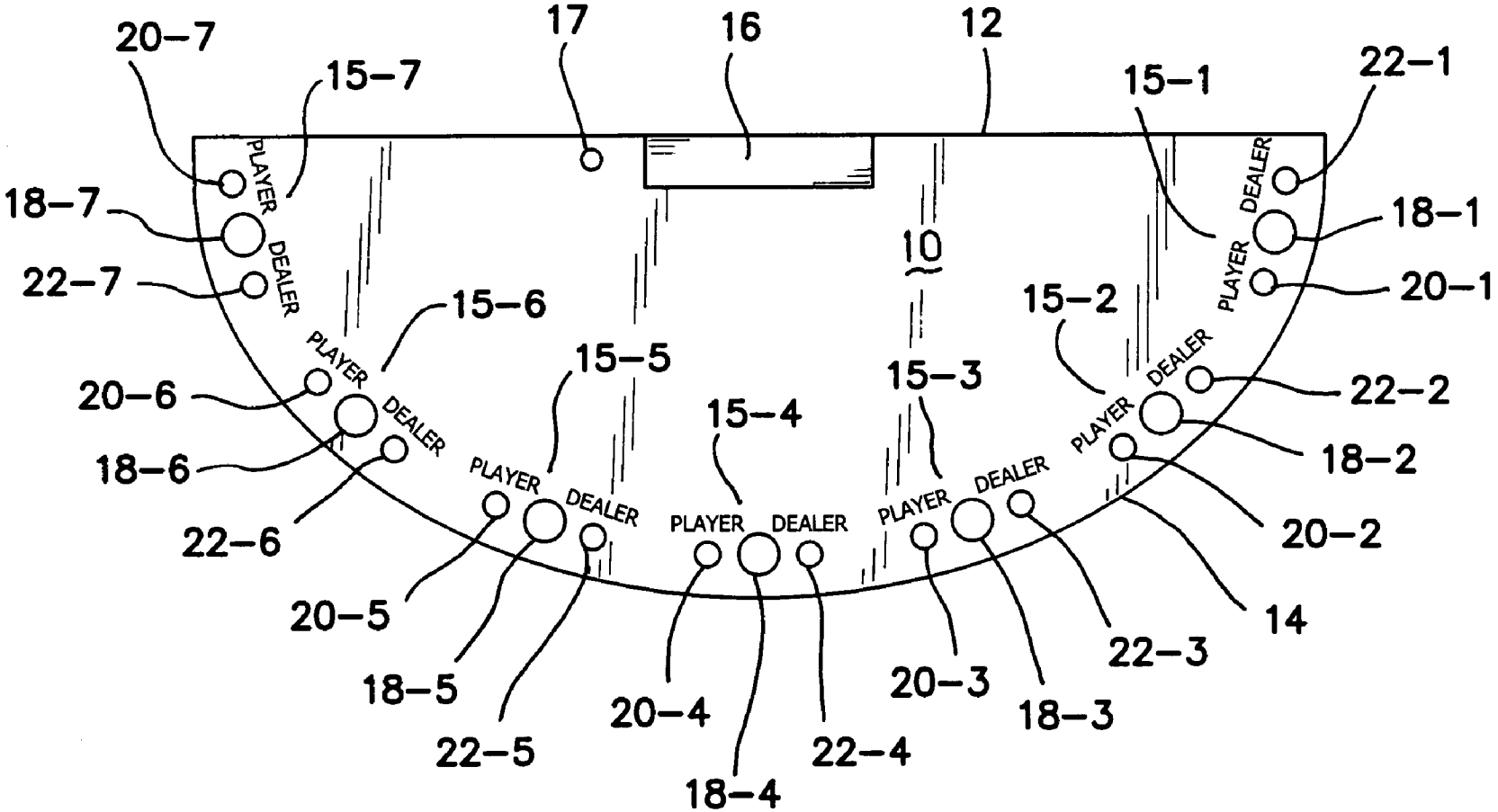
FIG. 1 is a first embodiment of a table layout for practicing the embodiments of the present invention.

As shown in FIG. 1, a game of twenty one is played on a table top 10 that has the general shape of a semi-circle. Accordingly, the table top 10 has a straight edge 12 and an arcuate edge 14. A rectangular dealer station 16 marked upon the table top 10 is adjacent to a central portion of the edge 12. A dealer's cards are placed upon the dealer station 16. A 2nd chance pushbutton 17 is adjacent to the dealer station 16. The purpose of the pushbutton 17 is explained hereinafter.

The table top 10 incorporates distinct player stations 15-1 through 15-7. Each distinct player station 15-1 through 15-7 includes wagering areas 18, 20 and 22. Wagering areas 18-1 through 18-7 are used for a conventional blackjack wager and wagering areas 20-1 through 20-7 are denoted as PLAYER 2nd chance wagering areas and wagering areas 22-1 through 22-7 are denoted as DEALER 2nd chance wagering areas.

A player places cheques, tokens, chips or cash (hereinafter "cheques") representative of a wager for the game of blackjack within the circle 18. Before cards are dealt, the player has an option making 2nd chance wagers. In one embodiment, a first type of 2nd chance wager is that the player's first two dealt cards have a total point count of "21." To make the wager, the player places cheques representative of the amount of the first type of 2nd chance wager within the circle 20. A second type of 2nd chance wager is that the dealer's first two dealt cards have a total point count of "21." To make the wager, the player places cheques representative of the amount of the second type of 2nd chance wager within the circle 22. When the player wins a 2nd chance wager, an amount that is won is determined as described hereinafter. It should be noted that other pre-established hands may result in a winning 2nd chance wager. For example, the 2nd chance wager may be won when the player receives three 7s or the dealer receives three 7s or a player or dealer receives three 2s in their hand. Truly, any conceivable card combination is within the scope of the present invention.

Figure 2:
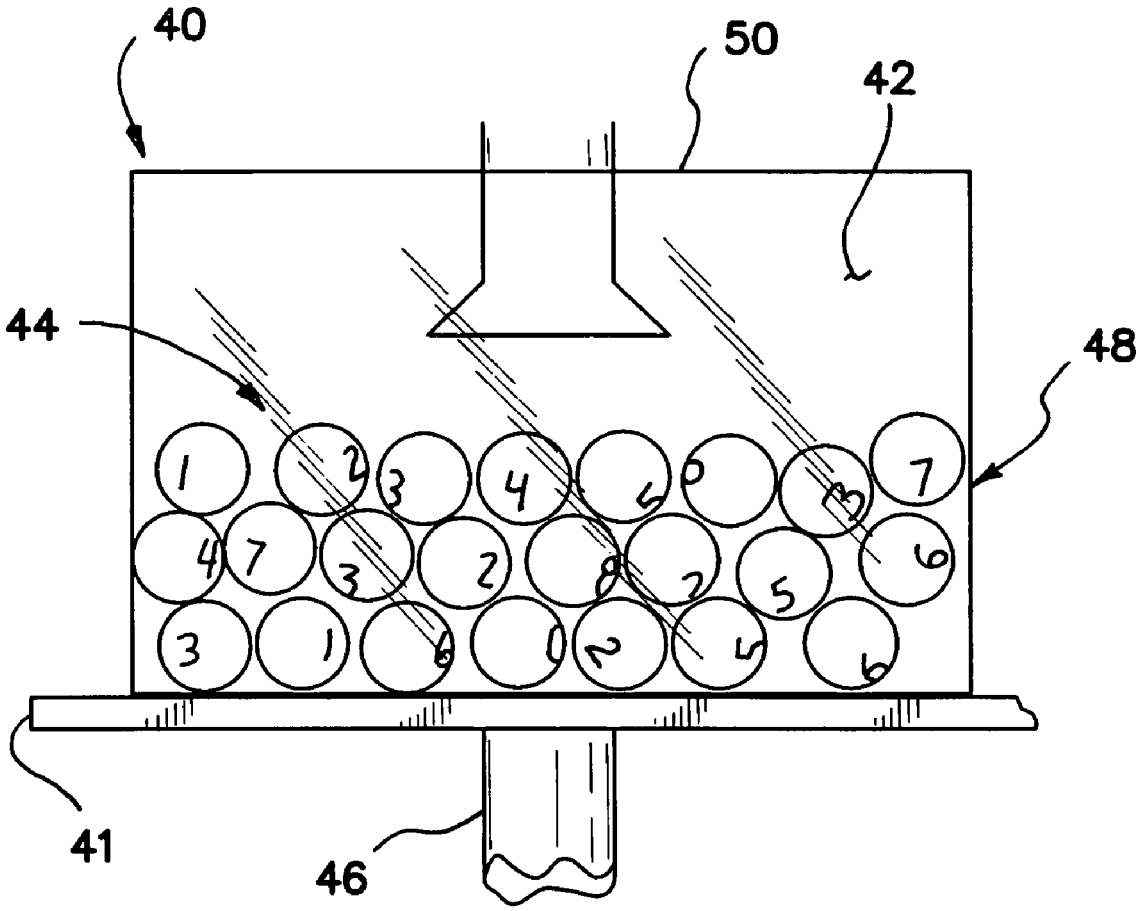
FIG. 2 is a side view of a numbered ball dispenser.

As shown in FIG. 2, a side view of a numbered ball dispenser 40 is mounted upon a table top 41 adjacent to the table top 10. The dispenser 10 is within view of all the players and the dealer. The 20 dispenser 40 includes a transparent container 42 that is similar to a container of a bingo ball or keno ball dispenser. The dispenser 40 may also be mounted directly to the table top 10 in view of the players.

A multiplicity of balls 44, similar to bingo balls, are within the container 42. The balls 44 are marked with numerals. An air entry tube is connected to the bottom of the container 42. A mesh (not shown) within the container 42 prevents the balls 44 from falling into the tube 46. A discharge tube 48 connects the interior of the container 42 to its exterior through atop 50 of the container 42.

When play ends with the dealer's total point count being "21," the dealer depresses the pushbutton 17. In response to the pushbutton 17 being depressed, air from a compressed air tank (not shown) flows into the tube 46 thereby agitating the balls 44. Additionally, the air forces one of the balls 44 through the tube 48 causing it to be captured therein and displayed to the players. The players who have won 2nd chance wagers win the amount of their 2nd chance wager multiplied by the number depicted on the ball that is captured. Alternatively, the numerals may correspond to cash equivalents and multiple captured balls may be used to determine an award.

In an alternative embodiment, the pushbutton 17 is mobile. When, for example, players win the 2nd chance wager, a first of the winning players is given the pushbutton. The first winning player depresses the pushbutton 17 to cause a first of the balls 44 to be captured. The amount of the first winning player's wager is multiplied by the number of the first ball to determine the amount that is won by the first winning player. In a similar manner, amounts won by each of the other winning players is determined. It is also, conceivable that when multiple players win the 2nd chance wager on the same hand, they each receive the same award determined by a single activation of the ball dispenser.

It is also envisioned that the embodiments of the present invention may be facilitated in an electronic gaming machine. For example, the game of blackjack can be played between a single player and a simulated dealer. A simulated ball dispenser will be used to determine the amount of the 2nd chance wager.

While the invention has been particularly shown and described with reference to a preferred embodiment, it should be understood by those skilled in the art that changes in form and detail may be made therein without departing from the spirit and scope of the invention.

I claim:

1. A method of playing a wagering game comprising:

accepting a first wager dependent upon conventional rules of the wagering game;

accepting a second wager, conducting said wagering game, said wagering game being conducted at a wagering game table wherein playing cards, dice and/or a roulette wheel are utilized;

resolving the first wager according to the conventional rules of the wagering game; and if an outcome of said wagering game is in a group of one or more pre-established outcomes, resolving said second wager by allowing a player to activate electrically linked button to activate a ball dispenser containing a plurality of balls, said ball dispenser incorporated on the wagering game table wherein said ball dispenser facilitates a selection of one or more random balls from within the dispenser, said one or more randomly selected balls determining a reward associated with said second wager.

2. The method of claim 1 wherein the wagering game is blackjack and one of the pre-established outcomes is a player being dealt blackjack.

3. The method of claim 1 wherein numerals depicted on said one or more selected balls act as a multiplier of the second wager such that the amount of the reward associated with the second wager is determined by multiplying the second wager by the numerals depicted on said one or more selected balls.

4. The method of claim 1 wherein numerals depicted on the one or more selected balls equal an amount of the reward associated with the second wager.

5. A wagering game comprising:

a gaming table having a layout including a first wager area and a second wager area, said first wager area corresponding to a first wager based on conventional rules of the wagering game, said second wager area corresponding to a second wager based on one or more pre-established wagering game outcomes;

a ball dispenser, holding a plurality of balls, incorporated on the gaming table wherein said ball dispenser facilitates a selection of one or more random balls from within the dispenser, said one or more selected random balls determining a reward associated with said second wager; and activation means for a dealer or player to activate the ball dispenser.

6. The game of claim 5 wherein the wagering game is blackjack and one of the pre-established wagering game outcomes is a player being dealt blackjack.

7. The game of claim 5 wherein the wagering game is blackjack and one of the pre-established wagering game comes is a dealer being dealt blackjack.

8. The game of claim 5 wherein numerals depicted on said one or more selected balls act as a multiplier of the second wager such that the amount of the reward associated with the second wager is determined by multiplying the second wager by the numerals depicted on said one or more selected balls.

9. The game of claim 5 wherein numerals depicted on said one or more selected balls equal an amount of the reward associated with the second wager.

10. A method of playing a game of blackjack comprising:

accepting a blackjack wager;

accepting a second wager based on a player being dealt blackjack;

conducting said game of blackjack;

resolving the blackjack wager according to conventional rules of blackjack;

and if the player is dealt blackjack, resolving said second wager by permitting a dealer or player to use a button to activate a ball dispenser containing a plurality of balls, said ball dispenser incorporated on a blackjack table wherein said ball dispenser facilitates a selection of one or more random balls from within said ball dispenser, said one or more selected random balls determining an award associated with said second wager.

11. The method of claim 10 wherein the second wager is based on a dealer being dealt blackjack.

* * * * *